US008206176B2

(12) United States Patent
Islam

(10) Patent No.: US 8,206,176 B2
(45) Date of Patent: Jun. 26, 2012

(54) CONNECTOR FOR COAXIAL CABLE HAVING ROTATIONAL JOINT BETWEEN INSULATOR MEMBER AND CONNECTOR HOUSING AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/706,147

(22) Filed: Feb. 16, 2010

(65) Prior Publication Data

US 2011/0201230 A1 Aug. 18, 2011

(51) Int. Cl.
*H01R 9/05* (2006.01)

(52) U.S. Cl. ..... 439/578

(58) Field of Classification Search ..... 439/578–585, 439/261, 446, 857
See application file for complete search history.

(56) References Cited

U.S. PATENT DOCUMENTS

| | | | | |
|---|---|---|---|---|
| 3,786,376 | A * | 1/1974 | Munson et al. | 333/261 |
| 4,326,769 | A | 4/1982 | Dorsey et al. | 339/177 |
| 5,137,470 | A * | 8/1992 | Doles | 439/578 |
| 5,354,217 | A * | 10/1994 | Gabel et al. | 439/583 |
| 5,795,188 | A | 8/1998 | Harwath | 439/583 |
| 6,561,848 | B1 * | 5/2003 | Khemakhem et al. | 439/580 |
| 6,575,786 | B1 * | 6/2003 | Khemakhem et al. | 439/580 |
| 6,592,403 | B2 | 7/2003 | Kooiman | 439/578 |
| 7,011,546 | B2 | 3/2006 | Vaccaro | 439/580 |
| 7,011,553 | B2 | 3/2006 | Hayashi et al. | 439/752 |
| 7,077,700 | B2 | 7/2006 | Henningsen | 439/583 |
| 7,131,858 | B1 * | 11/2006 | Zerebilov | 439/446 |
| 7,171,753 | B2 * | 2/2007 | Korczak et al. | 30/90.1 |
| 7,197,821 | B2 * | 4/2007 | Khemakhem et al. | 29/857 |
| 7,281,948 | B2 * | 10/2007 | Khemakhem et al. | 439/580 |
| 7,435,135 | B2 * | 10/2008 | Wlos | 439/584 |
| 2004/0266259 | A1 | 12/2004 | Moseley | 439/578 |
| 2006/0063426 | A1 * | 3/2006 | Khemakhem et al. | 439/580 |
| 2007/0175027 | A1 * | 8/2007 | Khemakhem et al. | 29/857 |
| 2010/0041271 | A1 | 2/2010 | Van Swearingen et al. | 439/583 |
| 2010/0126011 | A1 * | 5/2010 | Islam | 29/867 |

FOREIGN PATENT DOCUMENTS

| | | |
|---|---|---|
| EP | 0818854 | 1/1998 |

* cited by examiner

*Primary Examiner* — Jean F Duverne
(74) *Attorney, Agent, or Firm* — Allen, Dyer, Doppelt, Milbrath & Gilchrist, P.A.

(57) ABSTRACT

A connector is to be attached to a coaxial cable. The connector includes a connector housing having a cylindrical shape to be coupled to the outer conductor. An insulator member has a central opening therein and is rotatably received within the connector housing to define a rotational joint therewith. A center contact has a shaft portion securely received within the central opening of the insulator member and an open end portion extending rearwardly from the shaft portion to securely receive the inner conductor therein.

16 Claims, 16 Drawing Sheets

CONNECTOR FOR COAXIAL CABLE HAVING ROTATIONAL JOINT BETWEEN INSULATOR MEMBER AND CONNECTOR HOUSING AND ASSOCIATED METHODS

FIELD OF THE INVENTION

The present invention relates to the field of connectors for cables, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core. In addition, some inner conductors can be solid, for example comprising an inner aluminum layer and an outer copper layer.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

U.S. Pat. No. 5,795,188 to Harwath, for example, discloses a connector for a coaxial cable having a corrugated outer conductor. The connector includes a connector housing defining a radially outer ramp to contact the inside surface of a flared end portion of an outer conductor of the coaxial cable. A clamping ring is in the corrugation adjacent to the flared end portion of the outer conductor. The clamping ring presses the outer surface of the outer conductor against the radially outer ramp to provide electrical contact therebetween.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

U.S. Pat. No. 7,077,700 to Henningsen discloses a coaxial cable connector including a removable back nut, an outer body, and a center conductor supported within the outer body by a dielectric. An uncompressible clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is clamped between mating clamping surfaces formed on the clamp ring and the outer body.

Despite these developments in connector technology, a need remains for connectors that may facilitate easy installation and that may retain a good electrical contact with the coaxial cable under a variety of operating conditions, thereby reducing intermodulation distortion (IMD). Further, a need remains for connectors that may be securely attached to a coaxial cable and that are sealed against debris and moisture.

SUMMARY OF THE INVENTION

In view of the foregoing background, it is therefore an object of the present invention to provide an easier to install connector for a coaxial cable that maintains a good electrical contact with the coaxial cable under a variety of operating conditions.

This and other objects, features, and advantages in accordance with the present invention are provided by a connector to be attached to a coaxial cable comprising an inner conductor, an outer conductor, and a dielectric therebetween. The connector may include a connector housing having a cylindrical shape to be coupled to the outer conductor, and an insulator member having a central opening therein. The insulator member may be rotatably received within the connector hosing to define a rotational joint therewith. A center contact may have a shaft portion securely received within the central opening of the insulator member. In addition, the center contact may have an open end portion extending rearwardly from the shaft portion to securely receive the inner conductor therein. This design advantageously helps to reduce or eliminate rotation of the center contact about the inner conductor when the connector housing and back nut are rotatably engaged during connector installation. This helps to reduce damage to the inner conductor caused by rotation of the center contact thereabout, particularly to coaxial cables with aluminum inner conductors. When the inner conductor undergoes scraping caused by the rotation of the center contact thereabout, the diameter of the inner conductor may be reduced and the surface may be uneven, thereby degrading the electrical contact between the inner conductor and the center contact. In addition, loose metal chips may flake off the inner conductor. The presence of metal chips between the inner conductor and the center contact also worsens the electrical contact therebetween, increasing intermodulation distortion.

There may be cooperating first and second rotation locking features defined in the center contact and insulator member to prevent relative rotation therebetween. In addition, the connector may include a back nut to be coupled to the connector housing and to capture the outer conductor therebetween. The connector housing may define a radially outer ramp to receive the outer conductor thereagainst. A compressible ring may compressibly clamp the outer conductor against the ramp as the connector housing and the back nut are engaged. This compressible ring advantageously provides secure mechanical and electrical connections between the outer conductor and the connector housing. Furthermore, this maintains a sufficient clamping force on the outer conductor opposite the radially outer ramp even if the size and/or shape of the outer conductor changes due to thermal expansion or aluminum creep.

Further, the radially outer ramp may be angled such as to flare an end of the outer conductor as the coaxial cable is inserted into the connector housing. This helpfully reduces the amount of preparation performed on an end of the coaxial cable before installation of the connector thereon.

There may be an additional insulator member within the connector housing for carrying the rearwardly extending open end of the center contact. The insulator member may have a coefficient of friction of less than 0.7, and/or may comprise polyoxymethylene.

The connector may include a flexible ring to receive the outer conductor therethrough, defining a rotational joint therewith, and to be captured between the connector housing and the back nut. In addition, a grip ring may be positioned within the back nut and may define a rotational joint therewith. The grip ring may have a plurality of teeth to dig into the outer conductor.

The center contact may comprise a forward portion with a rearwardly extending projection, and a rearward portion having a recess defined in a forward portion thereof to receive the projection of the forward portion.

A method embodiment is directed to a method of making a connector to be attached to a coaxial cable comprising an inner conductor, an outer conductor, and a dielectric therebetween. An insulator member having a central opening therein may be rotatably positioned within a connector housing to define a rotational joint therewith. The method may further include positioning a center contact comprising a shaft portion to be securely received within the central opening of the insulator member. The center contact may be formed to have an open end portion extending rearwardly from the shaft portion to securely receive the inner conductor therein.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Figure 1:
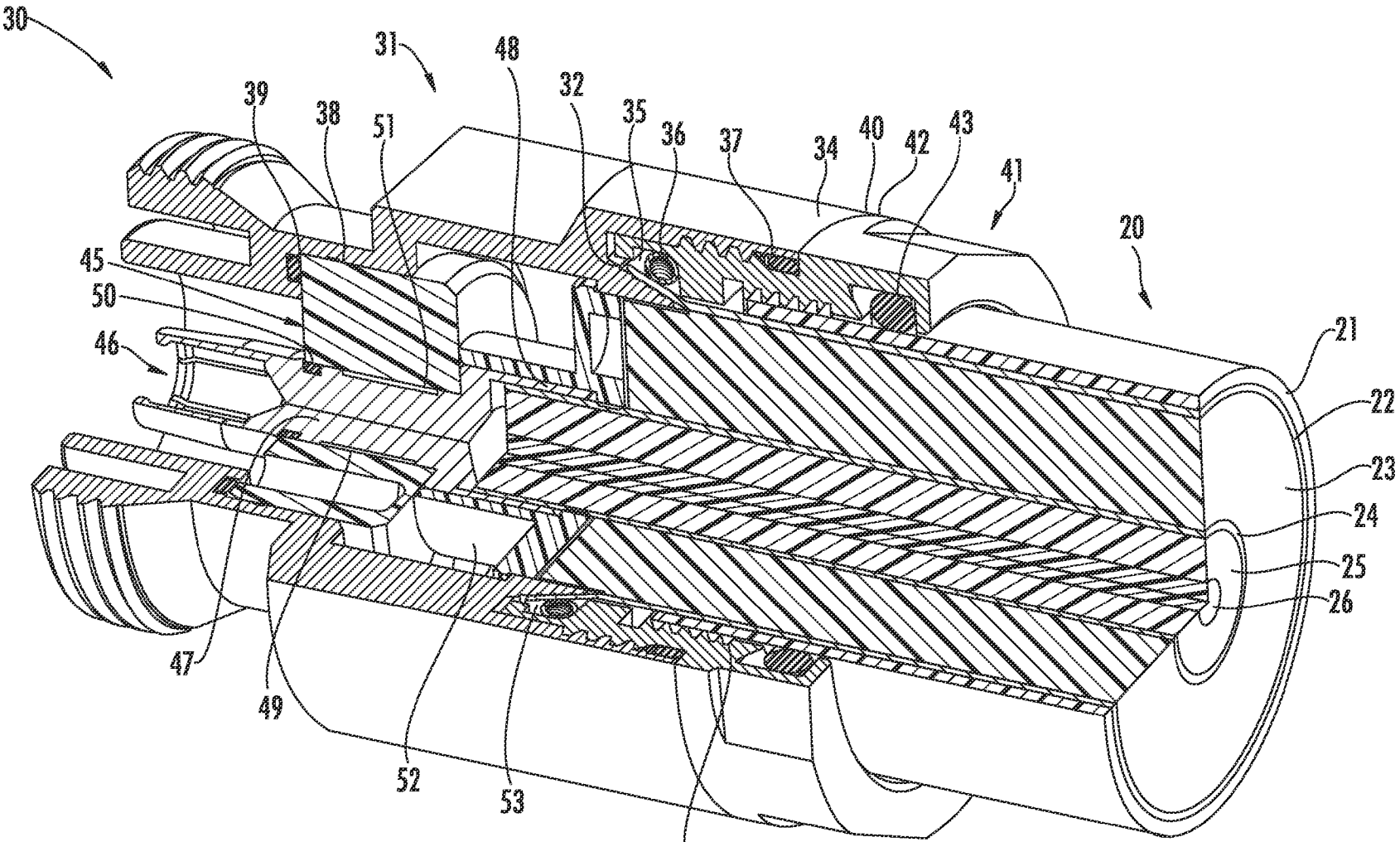
FIG. 1 is a perspective cutaway view of a connector installed on the end of a coaxial cable having a smooth outer conductor in accordance with the present invention.
Figure 2:
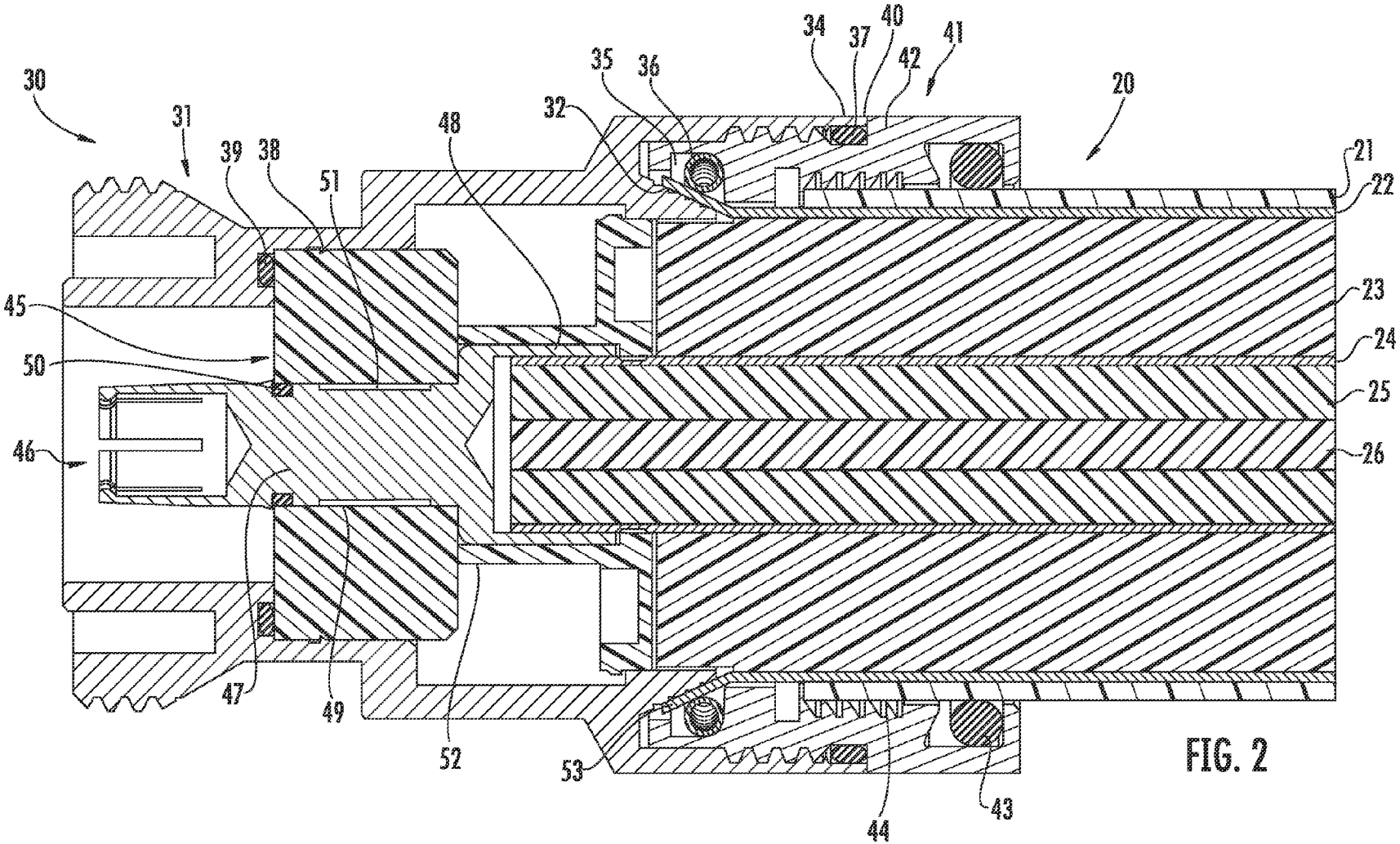
FIG. 2 is a longitudinal cross-sectional view of the connector of FIG. 1.

Referring initially to FIGS. 1-2, a connector 30 attached to a coaxial cable 20 is now described. The coaxial cable 20 comprises an inner conductor 24, an outer conductor 21, and a dielectric 23 therebetween. The inner conductor 24 (which may comprise aluminum, copper, copper clad aluminum, or other suitable type of metal) is a hollow inner conductor with an inner conductor rod 26, and an inner conductor dielectric 25 therebetween. The outer conductor 31 is illustratively a smooth outer conductor with a flared end 53, but could be a corrugated outer (helical or annular) conductor in other embodiments. In addition, the inner conductor 24 may in some applications be a solid inner conductor. The dielectric 23 may be a foam dielectric or other dielectric as known to those skilled in the art. The coaxial cable 20 illustratively includes an outer insulation jacket 21 stripped back a distance so that outer end portions of the outer conductor 22 are exposed.

The connector 30 includes an externally threaded back nut 41 received within an internally threaded rearward end 34 of a connector housing 31. Of course, in some applications, the back nut 41 may be internally threaded to receive an externally threaded connector housing 31. The connector housing 31 illustratively has a cylindrical shape. The back nut 41 includes threads 44 to dig into the jacket 21 to securely attach the back nut to the coaxial cable 20. Those skilled in the art will understand that these threads 44 are optional. A forward o-ring 37 and a rearward o-ring 43 are illustratively provided to seal respective forward and rearward interfaces adjacent the back nut 41 to thereby reduce or prevents moisture ingress.

An insulator member 45 is securely received within the connector housing 31 and has a central opening defined therein. A center contact 46 is positioned within the connector housing 31. A shaft portion 47 of the center contact 46 is rotatably received within the central opening of the insulator member 45 and defines a rotational joint 49 therewith. The shaft 47 has a recess 51 therein defining an air gap with adjacent portions of the insulator member 45 at the rotational joint 49. Alternatively, there may be a slip fit between the shaft 47 and adjacent portions of the insulator member 45 at the rotational joint.

Figure 13:
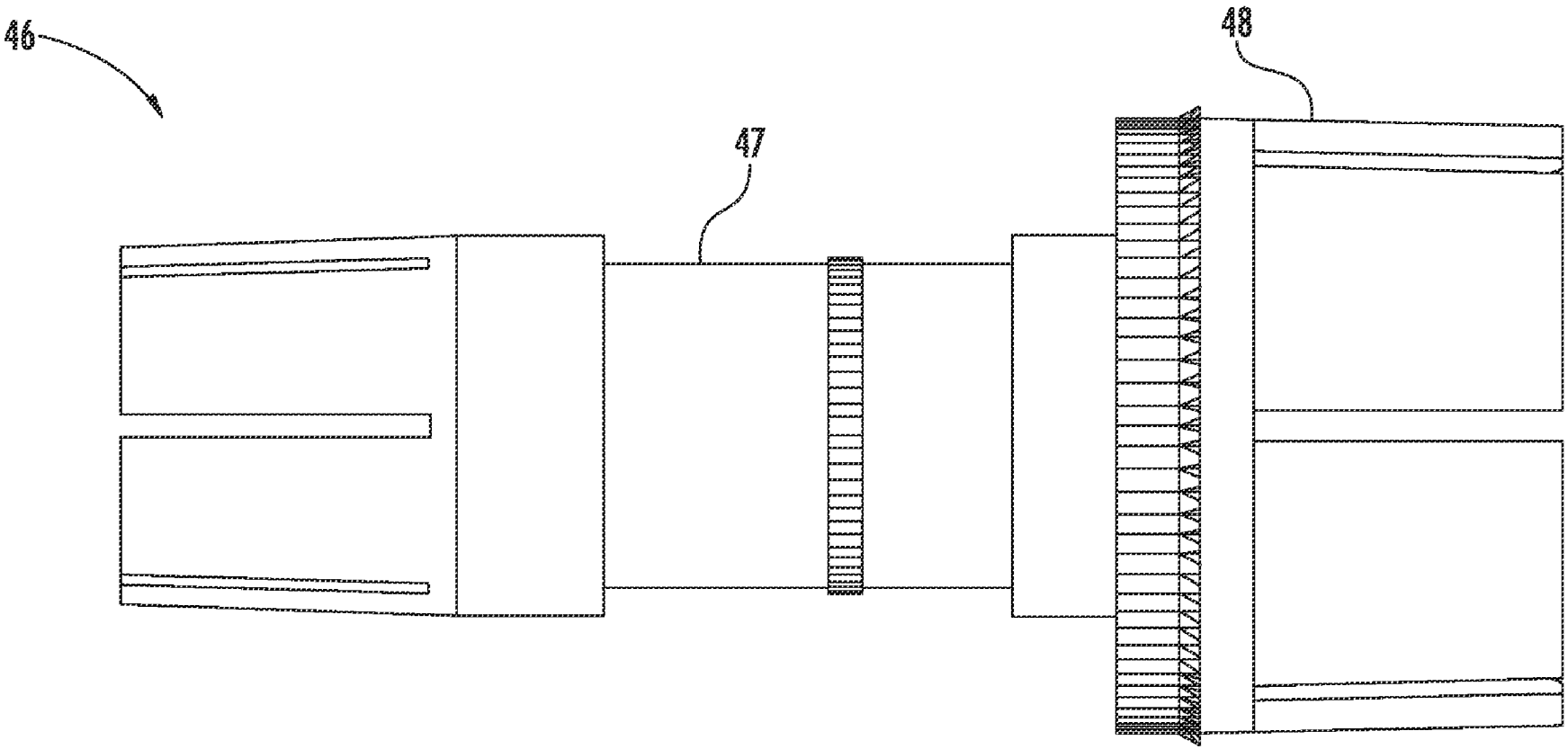
FIG. 13 is a perspective view of a center contact that may be used with the connector of the present invention.

An open end portion 48 of the center contact 46 extends rearwardly from the shaft portion 47 and securely receives the inner conductor 24 therein. In some applications, teeth (not shown) may extend radially inwardly from the inner diameter of the open end portion 48 to bite into the inner conductor 24, thereby helping to reduce axial movement therebetween. The open end portion 48 may have a diameter less than that of the inner conductor 24 so that it securely closes around the inner conductor 24. The radially inner surface of the open end portion 48 may optionally be knurled to increase friction with the inner conductor 24 (see FIG. 13).

This arrangement advantageously allows the connector housing 31 and insulator member 45 to rotate with respect to the center contact 46, while the center contact remains stationary with respect to the inner conductor 24, as the connector housing 31 and back nut 41 are rotatably engaged during installation of the connector 30 onto the coaxial cable 20. Applicant has found that relative rotation occurs between the center contact 46 and inner conductor 24, and this, in turn, causes pieces of the inner conductor to chip off and accumulate between the center contact and inner conductor. This may reduce the diameter of the inner conductor 24 or even etch threads into the inner conductor. The presence of these chips may increase contact resistance or reduce contact pressure between the inner conductor 24 and the center contact 46, causing increased signal degradation and IMD.

Figure 3:
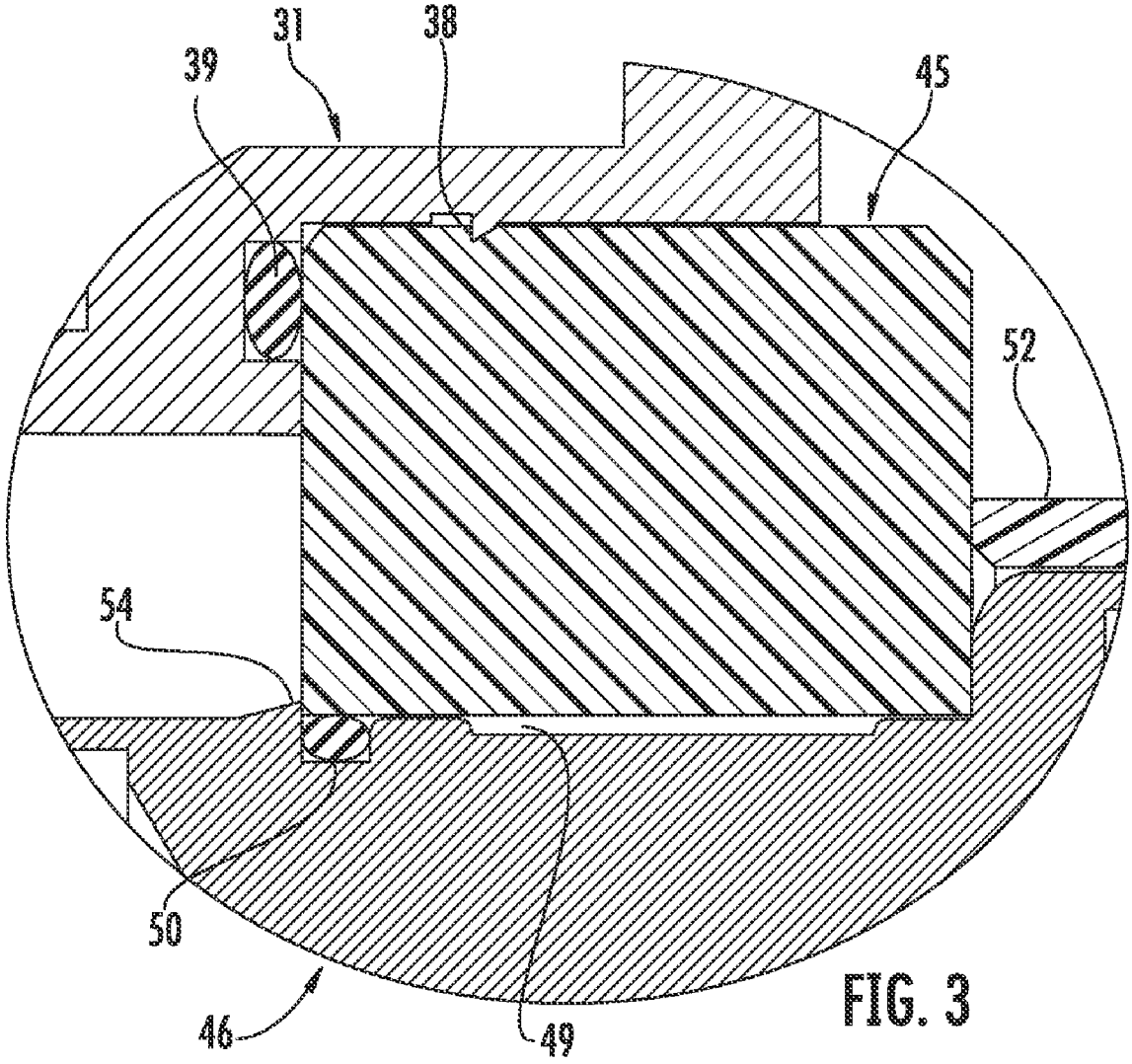
FIG. 3 is a greatly enlarged cross sectional view of the insulator member of FIG. 1.
Figure 4:
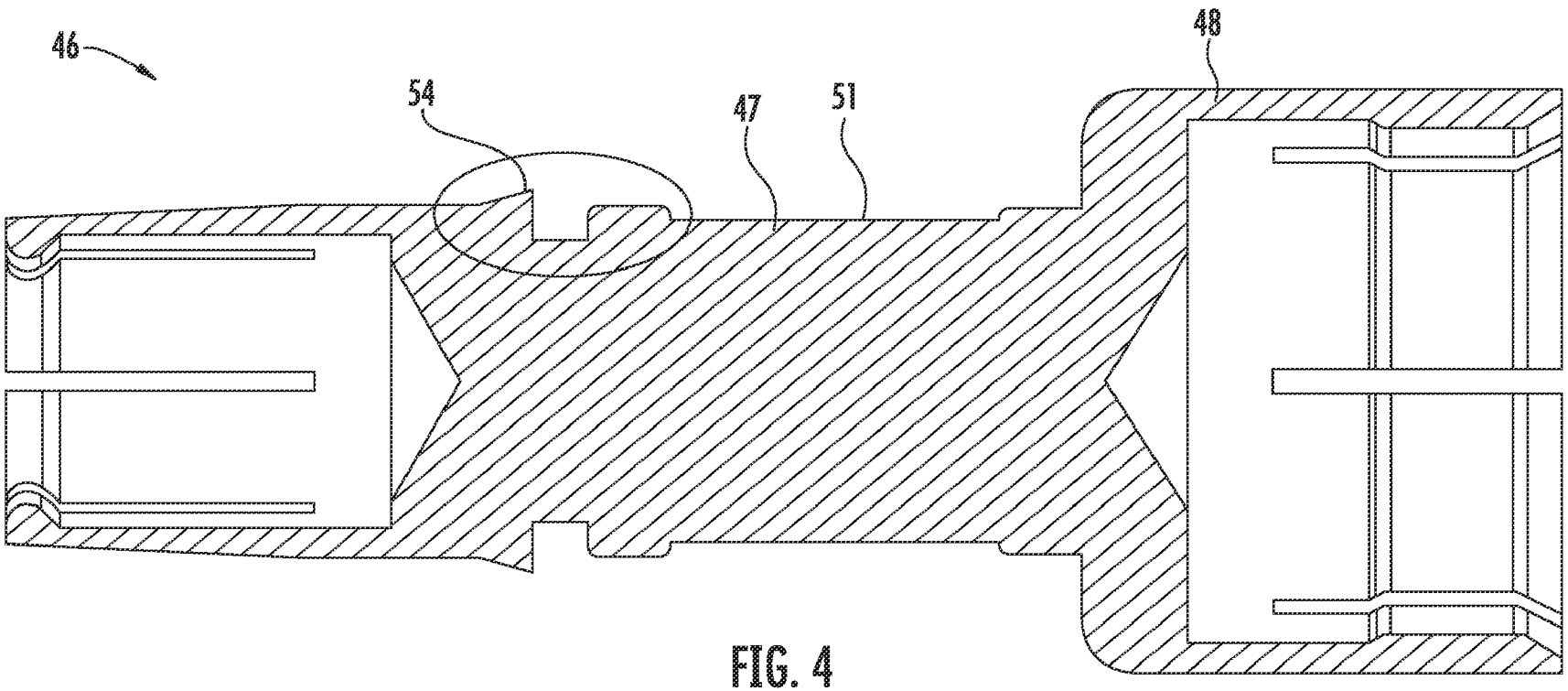
FIG. 4 is an enlarged cross sectional view of the center contact of FIG. 1.
Figure 5:
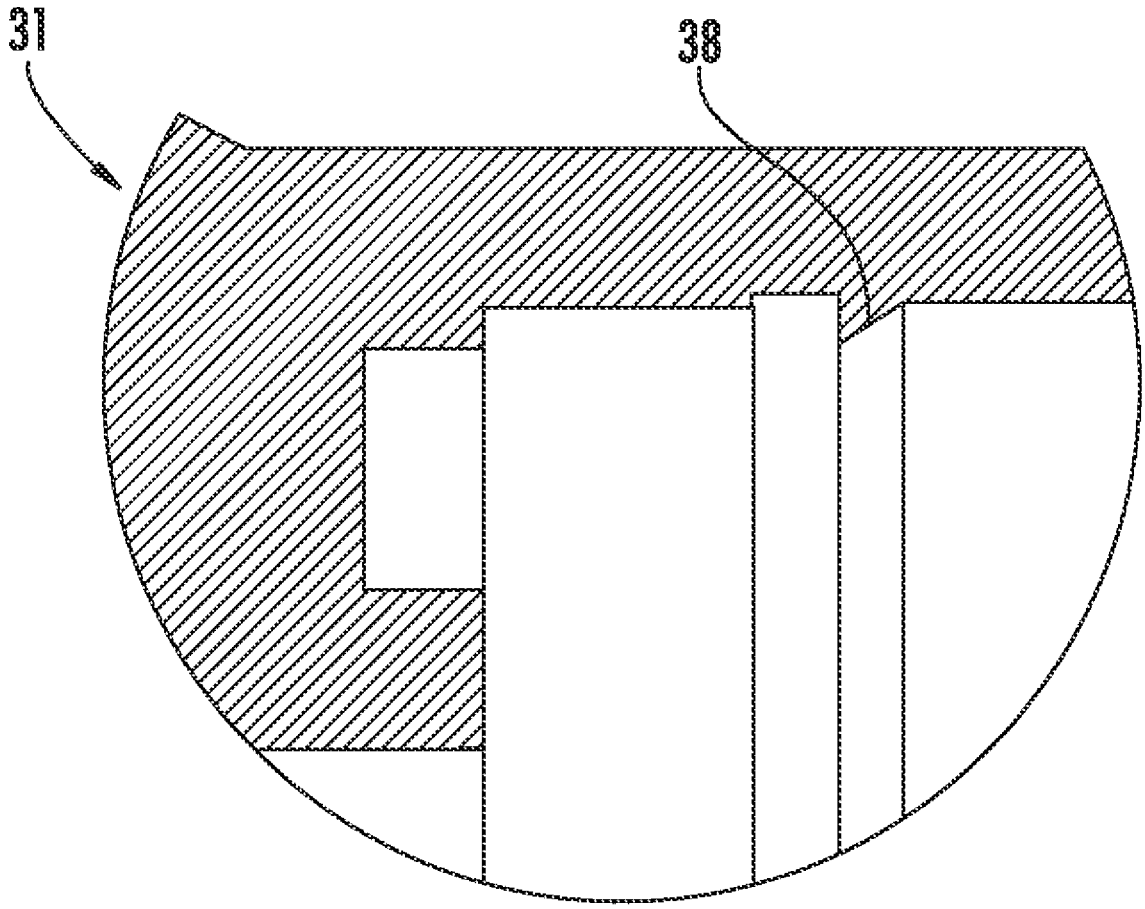
FIG. 5 is a greatly enlarged cross sectional view of the rotation locking feature of the connector housing of FIG. 1.

As perhaps best shown in FIGS. 3 and 5, a retaining projection 38, which could be a barb or knurled barb, extends radially inwardly from the inner diameter of the connector housing 31 and bites into the insulator member 45 to not only restrain the insulator member from rearward axial movement within the connector housing, but also to help prevent relative rotation between the insulator member and the connector housing. An additional retaining projection 54 extends radially outwardly from the outer diameter of the center contact 46 to restrain the insulator member 45 from forward axial movement within the connector hosing. As shown in FIG. 4, the retaining projection 54 is a shoulder that does not bite into the insulator member 45 itself. It should also be appreciated that the connector housing 31 and insulator member 45 may spin freely, and need not be coupled to other portions of the connector 30.

Referring once again to FIGS. 1-2, the connector housing 31 defines a ramp 32 to receive the outer conductor 22 thereagainst. The ramp 32 illustratively has a knurled surface, although the skilled artisan will understand that other ramp surfaces may be used. An electrically conductive compressible coil spring 36 compressibly clamps against the outer conductor 22 opposite the ramp 32 as the connector housing 31 and back nut 41 are engaged. The electrically conductive compressible coil spring 36 illustratively has an axis coaxial with that of the connector housing 31.

This clamping helps to provide an electrical connection between the outer conductor 22 and the ramp 32 by providing a constant contact pressure between the outer conductor and the ramp. By maintaining such a secure electrical connection, the IMD of signals traveling through the coaxial cable 20 may be reduced.

The electrically conductive compressible coil spring 36 advantageously maintains a sufficient clamping force on the outer conductor 22 even if the outer conductor changes shape or size due to thermal expansion or aluminum creep, for example, whereas an arrangement of two wedging surfaces to clamp the outer conductor might lose clamping force and contact pressure if the outer conductor were to change shape or size. The electrically conductive compressible coil spring 36 allows the connector 30 to be used on a variety of coaxial cables with different thicknesses, and on a variety of coaxial cables with outer conductors having different thicknesses.

Furthermore, the clamping provided by the electrically conductive compressible coil spring 36 further reduces radial movement of the connector 30 about the coaxial cable 30. That is, the electrically conductive compressible coil spring 36 acts as an anti-rotational device, such as a lock washer, to clamp the coaxial cable 20 between the connector housing 31 and back nut 41 and bites into the outer conductor 22 to reduce or prevent rotation of the connector 10 about the coaxial cable 30.

The ramp 32 is angled such as to flare an end 53 of the outer conductor 22 as the coaxial cable 20 is inserted into the connector housing 31. This advantageously reduces the preparation performed on the coaxial cable 20 before installation of the connector 30. Cable preparation now merely includes cutting the coaxial cable end flush and trimming the jacket 21 back. As the coaxial cable 20 is inserted into the connector 30 and the connector housing 31 and back nut 41 are engaged, the ramp 32 wedges between the outer conductor 22 and dielectric 23, thereby flaring the end 53 of the outer conductor.

An additional insulator member 52 is within the connector housing 31 for carrying the rearwardly extending open end 48 of the center contact 31. The additional insulator member 52 is positioned between the insulator member 45 and dielectric 23 of the coaxial cable 20 thereby restraining the insulator member from rearward axial movement and the coaxial cable from forward radial movement. There is a slip fit between the additional insulator member 52 and the rearwardly extending open end 48 of the center contact 31 such that the additional insulator member restrains the rearwardly extending open end from opening. This therefore may help reduce the chance of the open end 48 breaking.

The insulator member 45 optionally comprises a hard, low friction material having a coefficient of friction of less than 0.7. For example, polyoxymethylene is a particularly advantageous material from which to construct the insulator member 45. Other useful materials from which to construct the insulator member 45 include polymethylpentene, polytetrafluoroethylene, an injection moldable blend of polyoxymethylene and polytetrafluoroethylene, or a cross linked polystyrene microwave plastic. Of course, those of skill in the art will appreciate that other suitable materials may be used.

Figure 6:
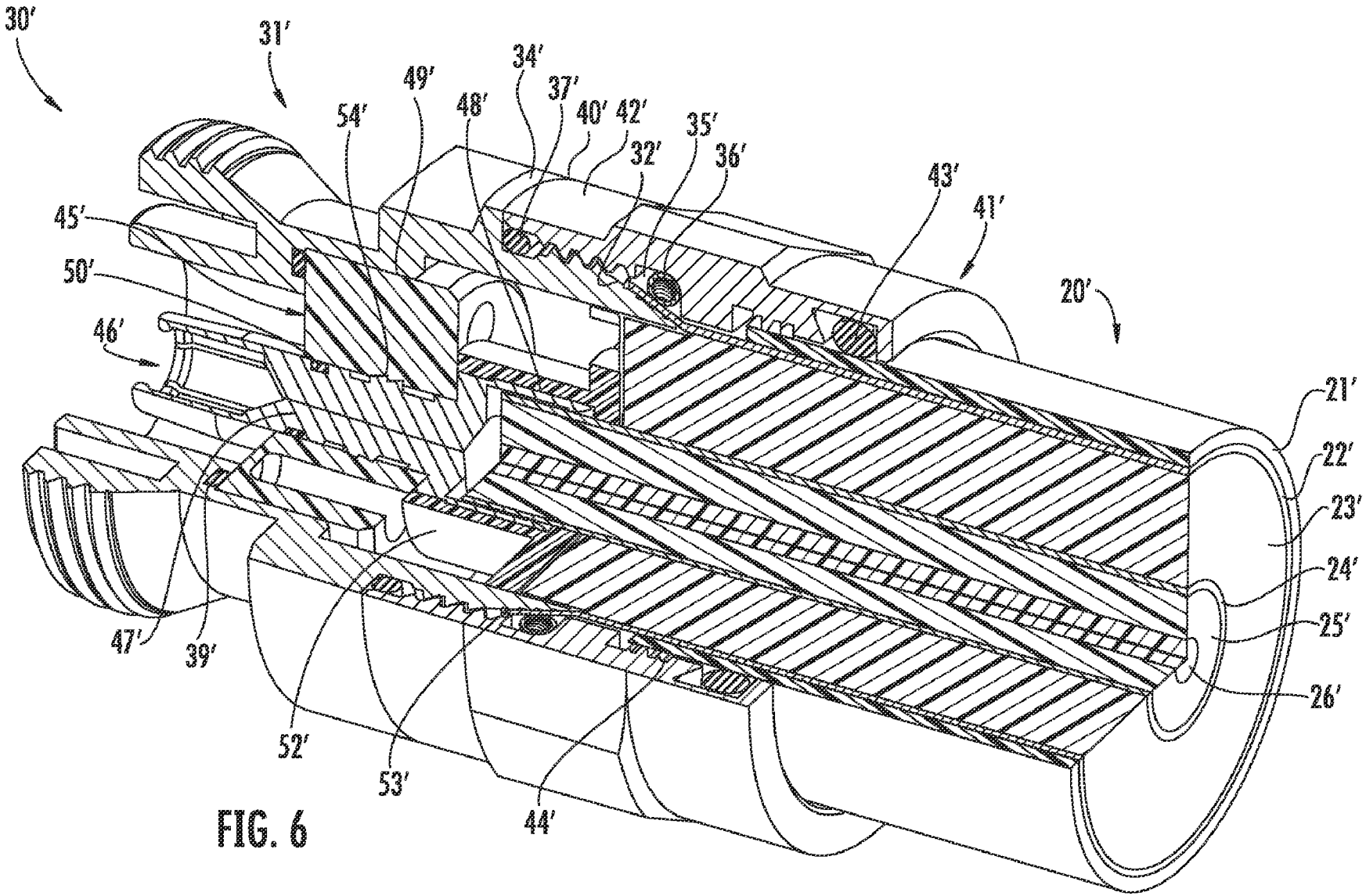
FIG. 6 is a perspective cutaway view of another embodiment of a connector installed on the end of a coaxial cable having a smooth outer conductor in accordance with the present invention.
Figure 7:
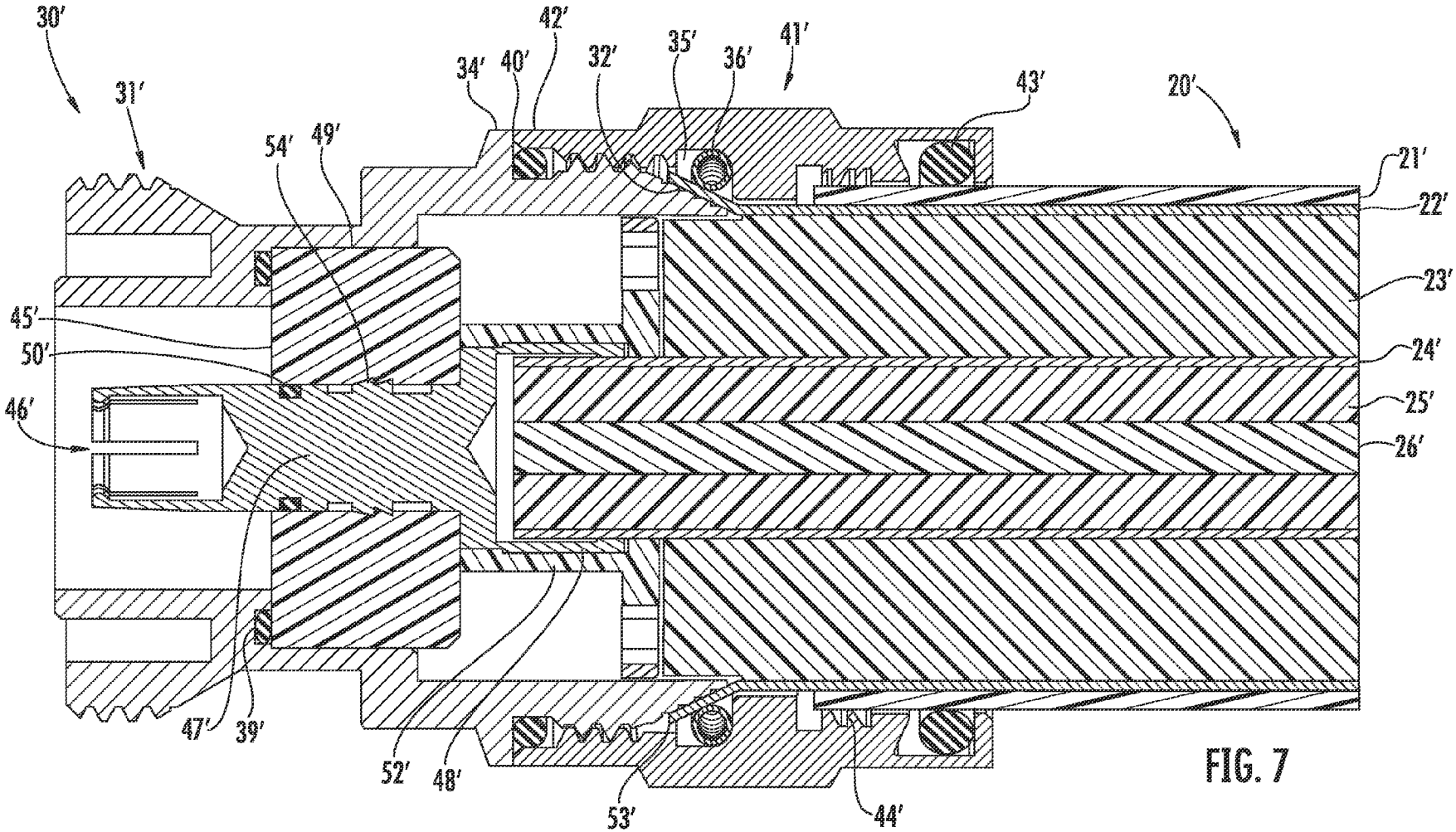
FIG. 7 is a longitudinal cross-sectional view of the connector of FIG. 6.
Figure 8:
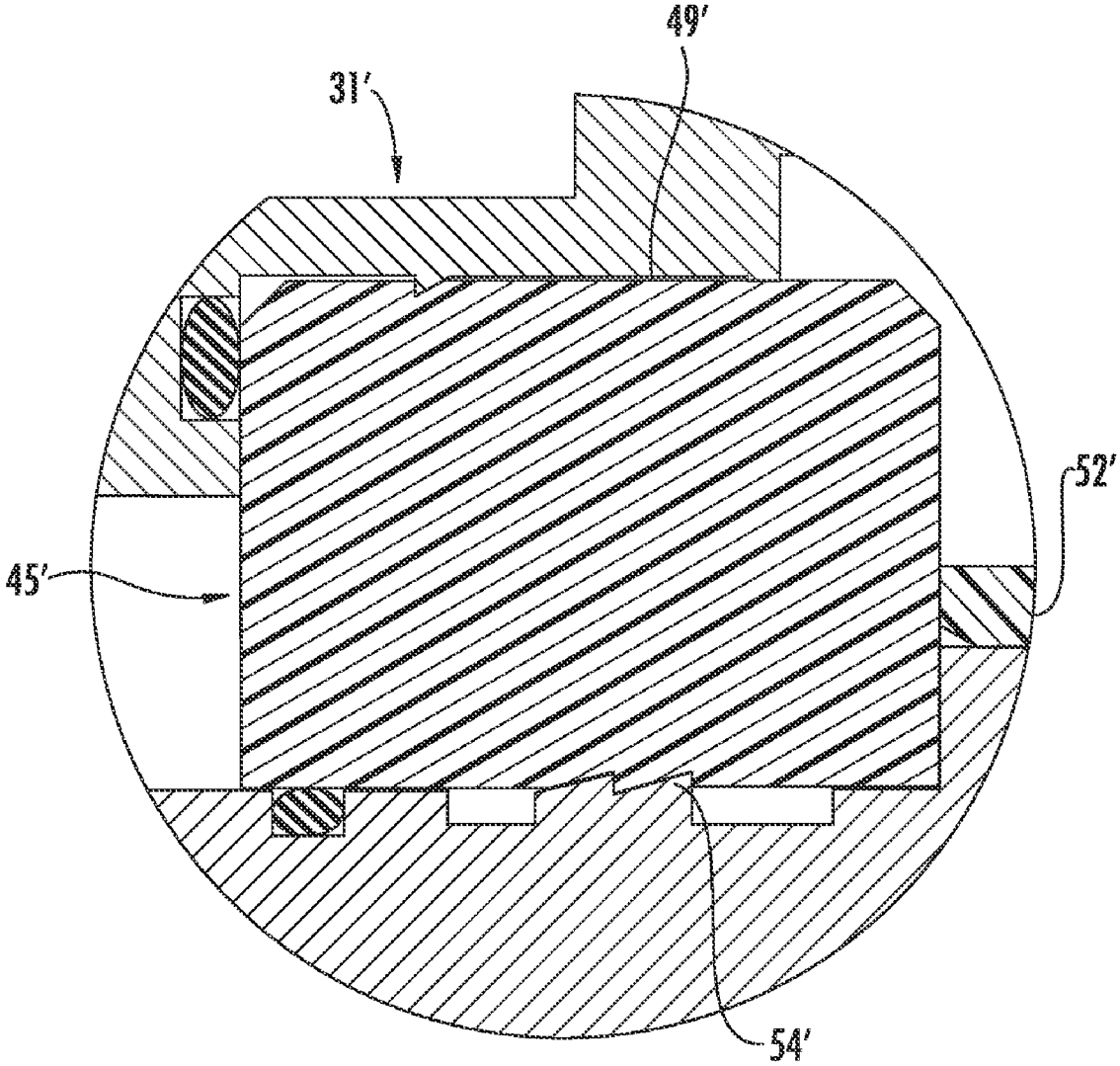
FIG. 8 is a greatly enlarged cross sectional view of the insulator member of FIG. 6.

Another embodiment of the connector 30' is now described with respect to FIGS. 6-7. Here, the back nut 41' is internally threaded and receives an externally threaded rearward end 43' of the connector housing. Further, the insulator member 45' is rotatably received within the connector housing 31', and securely receives the center contact 46' in its central opening. As perhaps best shown in FIG. 8, an optional rotation locking projection 54' extends radially outwardly from the outer diameter of the center contact 46' and bites into the insulator member 45' to both prevent forward axial movement of the insulator member. As such, in this illustrated embodiment, a rotational joint 54' is defined between the insulator member 45' and the connector housing 31'. During connector installation, the connector housing 31' may thus be rotated with respect to the insulator member 45' and center contact 46', which remains stationary with respect to the inner conductor 24'. As explained above, this helps to reduce the formation of chips between the center contact 46' and the inner conductor 24', thereby reducing IMD. It should be understood that in some applications, the insulator member 45' may also rotate with respect to the center contact 46.

Other elements of this embodiment not specifically mentioned are similar to those of the connector 30 described with reference to FIGS. 1-2 above and require no further discussion herein.

Figure 9:
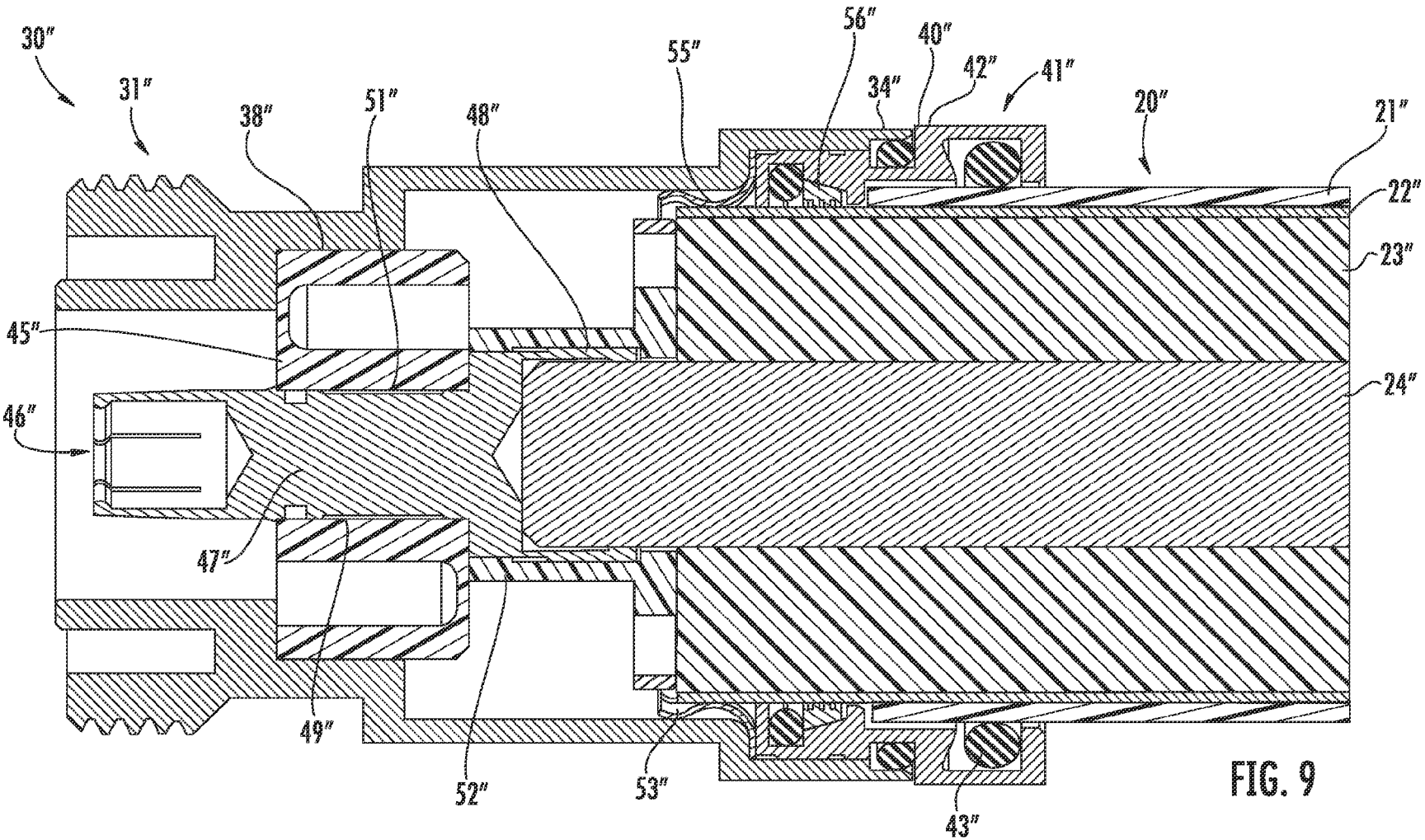
FIG. 9 is a longitudinal cross-sectional view of a further embodiment of a connector installed on the end of a coaxial cable having a smooth outer conductor in accordance with the present invention.
Figure 10:
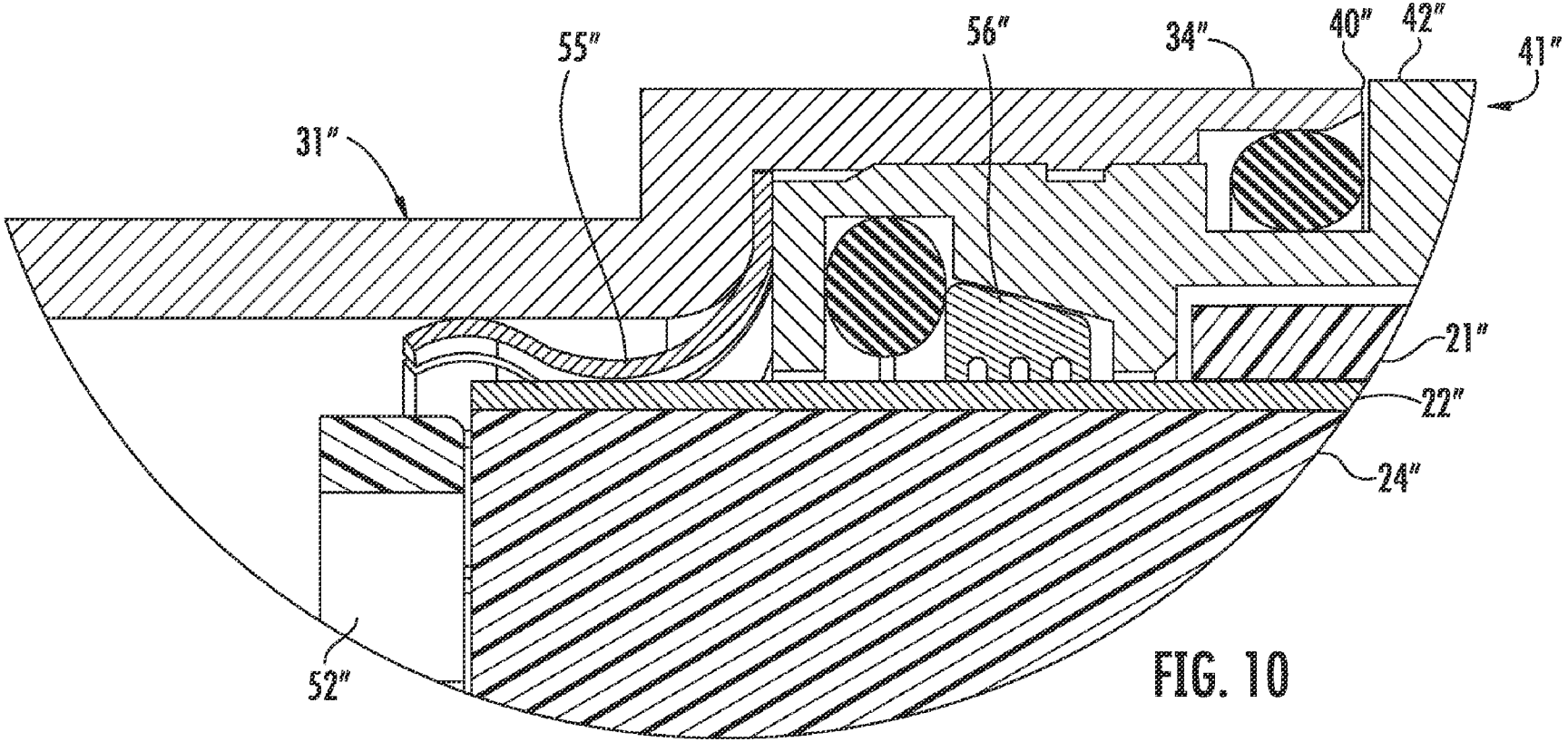
FIG. 10 is an enlarged cross-sectional view of the flexible ring of FIG. 9.
Figure 11A:
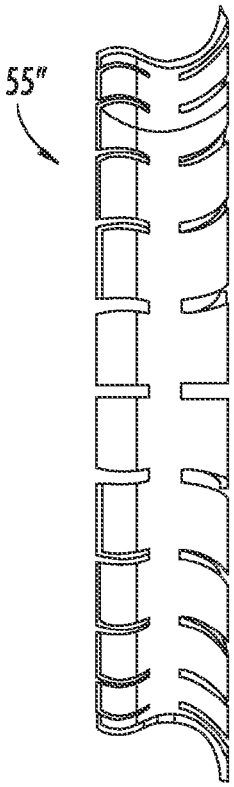
FIG. 11A is a side view of the flexible ring of FIG. 9.
Figure 11B:
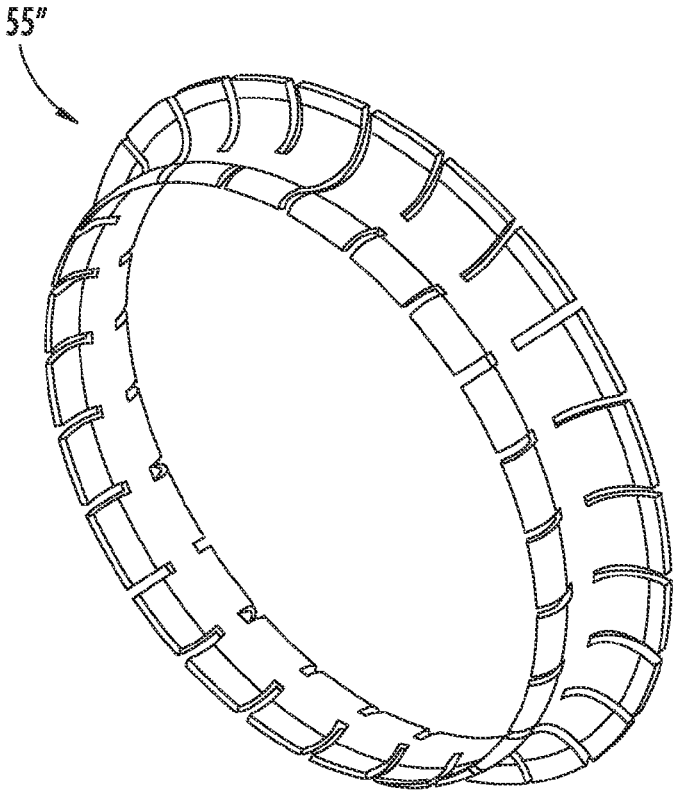
FIG. 11B is a perspective view of the flexible ring of FIG. 9.
Figure 12:
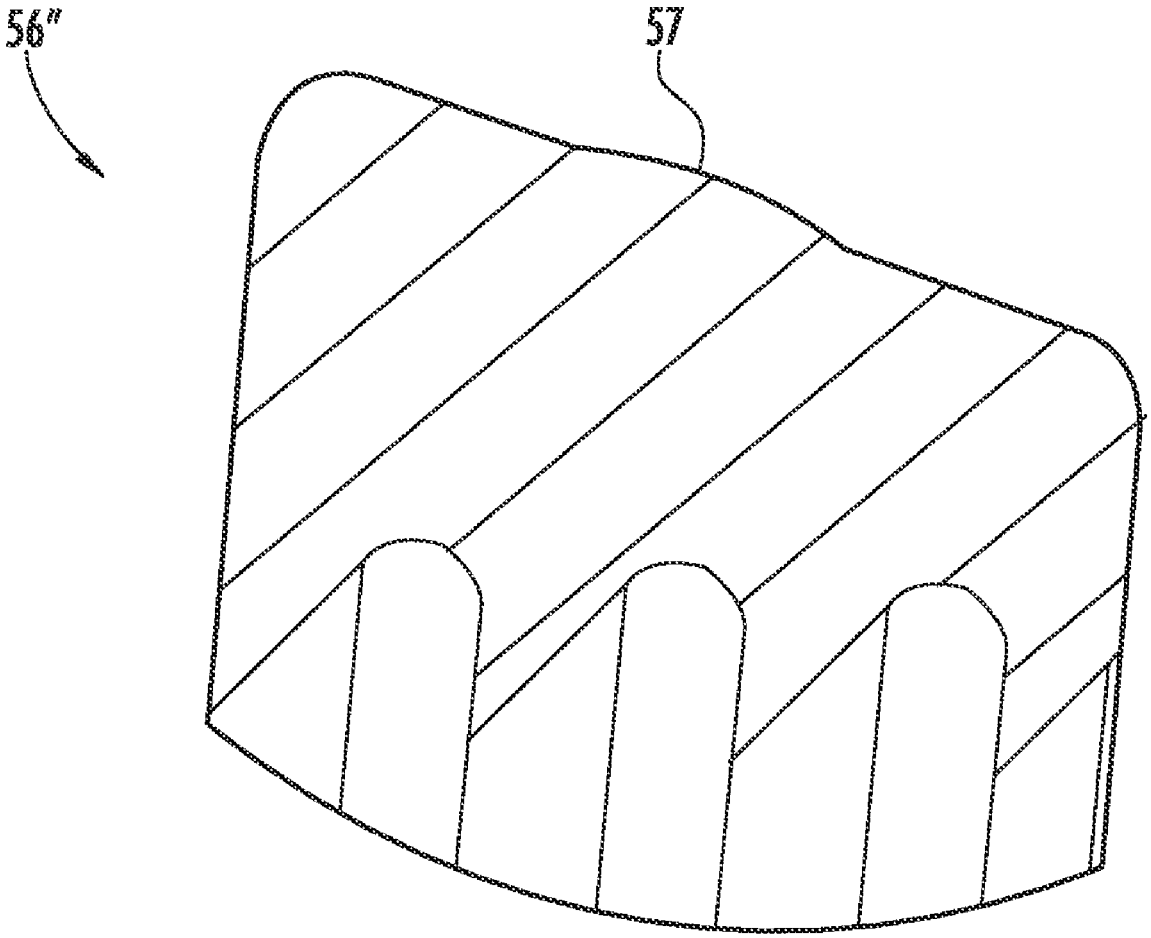
FIG. 12 is a greatly enlarged cross sectional view of the grip ring of FIG. 9.

A further embodiment of the connector 30" is now described with respect to FIGS. 9-11. Here, the outer conductor 22" is not flared. Also, the connector housing 31" and back nut 41" are not threaded. Instead, a forward portion of the back nut 41" is received within a rearward portion of the connector housing 31". Further, there is no ramp and no electrically conductive compressible coil spring in this embodiment. Rather, there is an electrically conductive flexible ring 55", a rearward portion of which is captured between the connector housing 31" and back nut 41". The electrically conductive flexible ring 55" illustratively has a reverse S shape, although it may take other shapes in other applications. The electrically conductive flexible ring 55" presses against both the inner diameter of the connector housing 31" and the outer conductor 22", creating a secure electrical connection therebetween. The electrically conductive flexible ring 55" receives the outer conductor 31" therethrough, and defines a rotational joint therewith. To facilitate this rotational joint, both the inner and the outer diameter of the electrically conductive flexible ring 55" may be low friction.

A grip ring 56" is positioned in the back nut rearwardly of the electrically conductive flexible ring 55". The grip ring 56" has a plurality of forward pointing teeth that bite into the outer conductor 22", helping to reduce or eliminate axial movement of the coaxial cable 20" in a rearward direction.

The grip ring 56" may define a rotational joint with the back nut 41". To facilitate the relative rotation between the grip ring 56" and the back nut 41", the grip ring may have a low friction outer diameter. It should be appreciated that, in this embodiment, the connector hosing 31", back nut 41", insulator member 45", electrically conductive flexible ring 55", and grip ring 56" may rotate separately with respect to the coaxial cable 20" and/or with respect to each other.

The grip ring 56" has an optional rounded projection 57" extending outwardly from an outer diameter thereof. This rounded projection 57" engages the back nut 41", thereby reducing the contact area between the grip ring 56" and the back nut, enabling the grip ring to rotate easily thereabout.

Other elements of this embodiment not specifically mentioned are similar to those of the connector 30 described with reference to FIGS. 1-2 above and require no further discussion herein.

Figure 15:
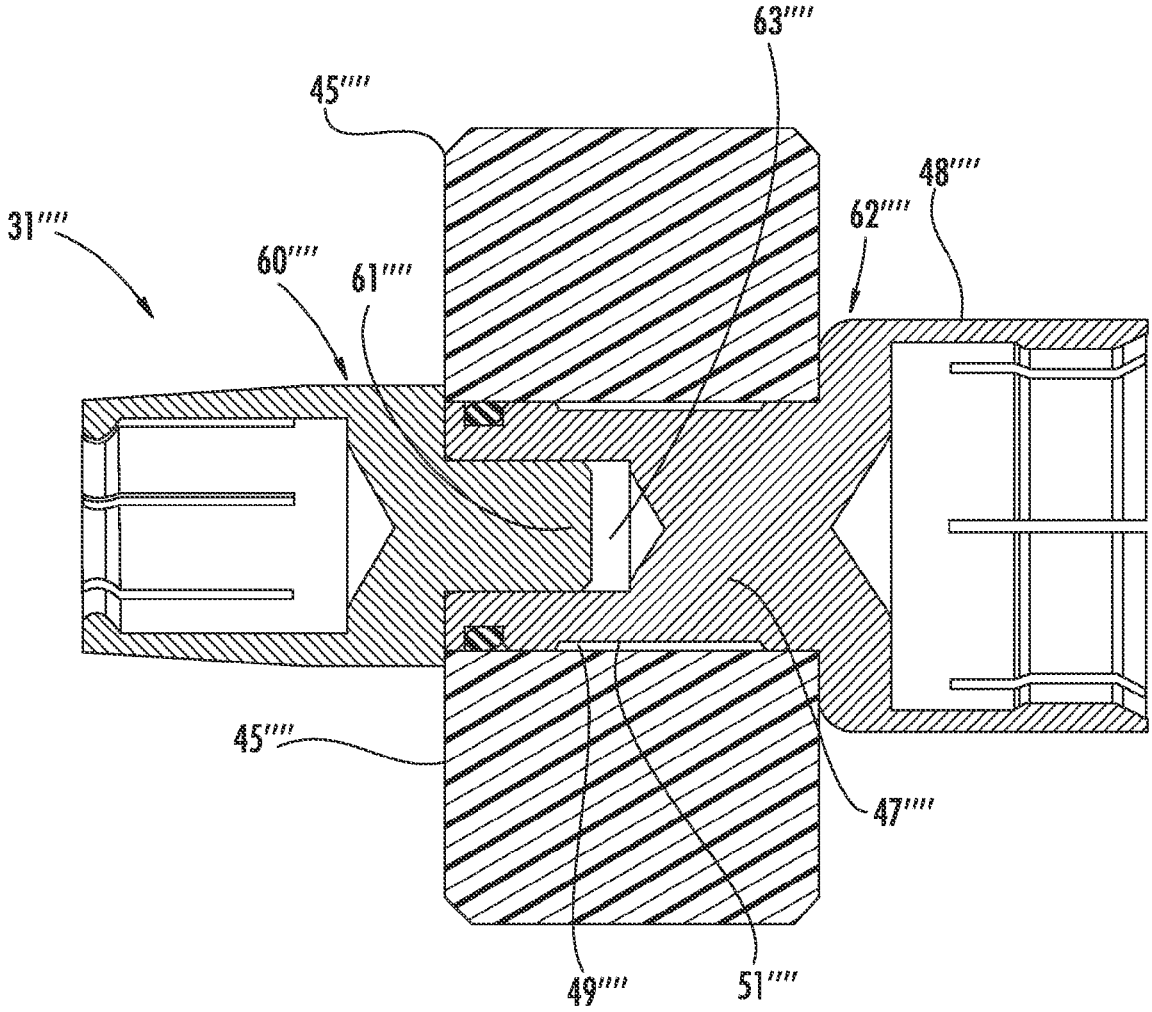
FIG. 15 is a longitudinal cross-sectional view of a two-piece center contact that may be used with the connector of the present invention.

In some applications, the center contact 31"" may be a two-piece center contact (see FIG. 15). In this instance, the center contact 31"" comprises a forward portion 60"" with a rearwardly facing projection 61". A rearward portion 62"" of the center contact 31"" includes a forward facing recess 63"" to receive the projection 61"". The rearward portion 62"" includes the shaft 47"" and the open end portion 48"". Those skilled in the art will understand that in some applications, the projection 61"" and the recess 63"" may be threaded.

In addition, the forward portion 60"" has a diameter greater than that of the shaft 47"" to thereby capture the insulator member 45"" between the forward portion and the open end portion 48"". This helps to restrain the insulator member 45"" from unwanted longitudinal movement.

Figure 14:
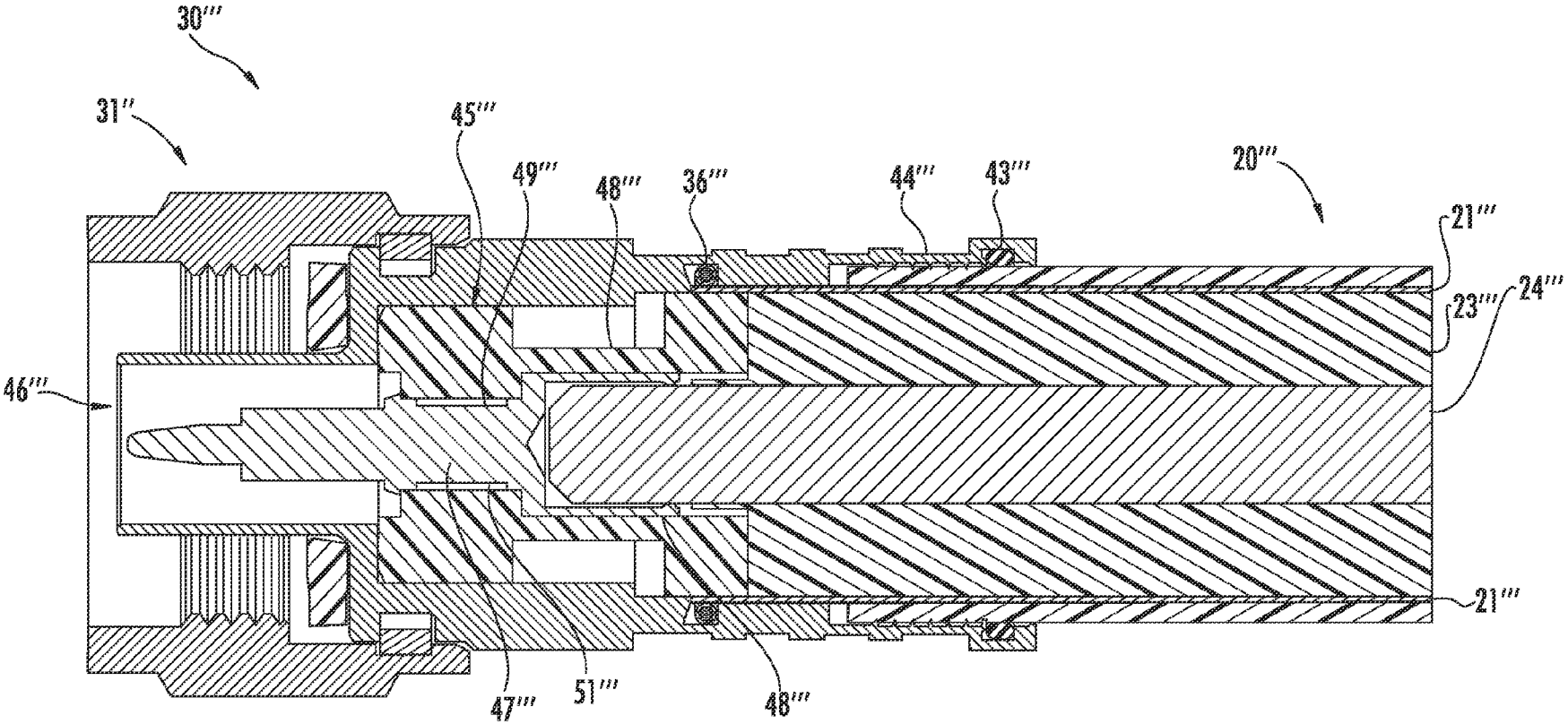
FIG. 14 is a longitudinal cross-sectional view of an additional embodiment of a connector installed on the end of a coaxial cable having a smooth outer conductor in accordance with the present invention.

An additional embodiment of a connector 30'" for a coaxial cable 20'" is now described with reference to FIG. 14. This connector 30'" does not have a back nut. Rather, the connector housing 31'" housing received the coaxial cable 20'". Other elements of this embodiment not specifically mentioned are similar to those of the connector 30 described with reference to FIGS. 1-2 above and require no further discussion herein.

Figure 16:
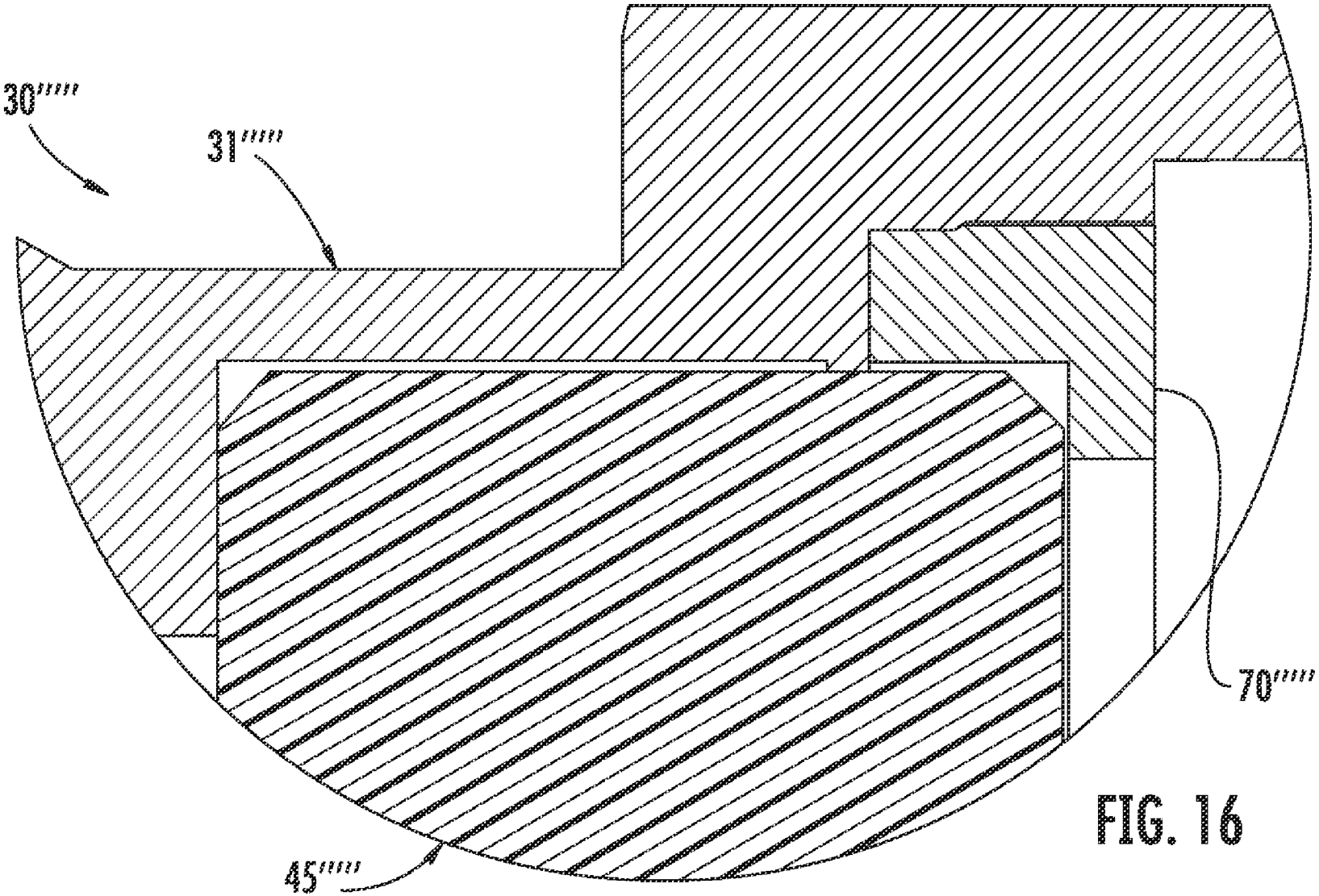
FIG. 16 is a greatly enlarged cross-sectional view of an alternative embodiment of the connector of the present invention.

Yet another embodiment of a connector 30"" for a coaxial cable is now described with reference to FIG. 16. In this embodiment, an L-shaped insulator member locking feature 70"" is positioned between the insulator member 45"" and the connector hosing 31"". This locking feature 70"" helps reduce or prevent axial movement of the insulator member 45"" with respect to the connector hosing 31"". The locking feature 70"" is illustratively constructed from metal, but may also be constructed from rubber, a polymer, or other suitable material. The locking feature 70"" may be threadingly received by the connector housing 31"" or may be pressed into the connector hosing during assembly. Other elements of this embodiment not specifically mentioned are similar to those of the connector 30 described with reference to FIGS. 1-2 above and require no further discussion herein.

Other details of such connectors 30 for coaxial cables 20 may be found in co-pending application, CONNECTOR FOR COAXIAL CABLE HAVING ROTATIONAL JOINT BETWEEN INSULATOR MEMBER AND CENTER CONTACT AND ASSOCIATED METHODS, Ser. No. 12/706,135, the entire disclosure of which is hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is

1. A connector to be attached to a coaxial cable comprising an inner conductor, an outer conductor, and a dielectric therebetween, the connector comprising:

a connector housing having a cylindrical shape to be coupled to the outer conductor, said connector housing being electrically conductive and electrically and mechanically coupled to the outer conductor;

an insulator member having a central opening therein and rotatably received within said connector housing to define a rotational joint therewith; and a center contact comprising a shaft portion securely received within the central opening of said insulator member and an open end portion extending rearwardly from said shaft portion to securely receive the inner conductor therein.

2. The connector of claim 1, further comprising cooperating first and second rotation locking features defined in said center contact and insulator member to prevent relative rotation therebetween.

3. The connector of claim 1, further comprising a back nut to be coupled to the connector housing and to capture the outer conductor therebetween.

4. The connector of claim 3, wherein said connector housing defines a radially outer ramp to receive the outer conductor thereagainst; and further comprising a compressible ring to compressibly clamp the outer conductor against the ramp as said connector housing and said back nut are engaged.

5. The connector of claim 4, wherein the radially outer ramp is angled such as to flare an end of the outer conductor as the coaxial cable is inserted into said connector housing.

6. The connector of claim 1, further comprising an additional insulator member within said connector housing for carrying the rearwardly extending open end of said center contact.

7. The connector of claim 1, further comprising a flexible ring to receive the outer conductor therethrough, defining a rotational joint therewith, and to be captured between said connector housing and said back nut.

8. The connector of claim 1, further comprising a grip ring positioned within said back nut and defining a rotational joint therewith, said grip ring having a plurality of teeth to dig into the outer conductor.

9. The connector of claim 1, wherein said insulator member has a coefficient of friction of less than 0.7.

10. The connector of claim 1, wherein the insulator member comprises polyoxymethylene.

11. The connector of claim 1, wherein the center contact comprises:

a forward portion with a rearwardly extending projection; and a rearward portion having a recess defined in a forward portion thereof to receive the projection of the forward portion.

12. A connector to be attached to a coaxial cable comprising an inner conductor, an outer conductor, and a dielectric therebetween, the connector comprising:

a connector housing having a cylindrical shape, said connector housing being electrically conductive and electrically and mechanically coupled to the outer conductor;

a back nut to be coupled to the connector housing and to capture the outer conductor therebetween;

an insulator member having a central opening therein and rotatably received within said connector housing to define a rotational joint therewith;

a center contact comprising a shaft portion securely received within the central opening of said insulator member and an open end portion extending rearwardly from said shaft portion to securely receive the inner conductor therein; and an additional insulator member within said connector housing for carrying the rearwardly extending open end of said center contact.

13. The connector of claim 12, further comprising cooperating first and second rotation locking features defined in said center contact and insulator member to prevent relative rotation therebetween.

14. The connector of claim 12, wherein said connector housing defines a radially outer ramp to receive the outer conductor thereagainst; and further comprising a compressible ring to compressibly clamp the outer conductor against the ramp as said connector housing and said back nut are engaged.

15. The connector of claim 14, wherein the radially outer ramp is angled such as to flare an end of the outer conductor as the coaxial cable is inserted into said connector housing.

16. The connector of claim 12, further comprising an additional insulator member within said connector housing for carrying the rearwardly extending open end of said center contact.

* * * * *